United States Patent [19]

Colombi

[11] Patent Number: 4,948,334

[45] Date of Patent: Aug. 14, 1990

[54] DISPLACEMENT TYPE ROTARY INDUCTION-BLOWER MACHINE

[75] Inventor: Giuseppe Colombi, Roncole Verdi, Italy

[73] Assignee: Esam S.p.A., Parma, Italy

[21] Appl. No.: 340,889

[22] Filed: Apr. 19, 1989

[30] Foreign Application Priority Data

Jul. 15, 1988 [IT] Italy ..... 40117A/88

[51] Int. Cl.[5] ..... F04D 1/10

[52] U.S. Cl. ..... 415/167.1; 415/55.6; 415/182.1

[58] Field of Search ..... 415/167.1, 55.5, 55.6, 415/55.1, 55.2, 55.3, 55.4, 182.1, 198.1, 203, 52.1

[56] References Cited

U.S. PATENT DOCUMENTS 3,135,215 6/1964 Smith ..... 415/167.1

4,204,800 5/1980 Bentele et al. ..... 415/167.1

*Primary Examiner*—John T. Kwon

*Attorney, Agent, or Firm*—Darby & Darby

[57] ABSTRACT

A displacement type rotary air blower which, as a single-stage unit, comprises a single impeller (1) encased between a first half-shell (2) and a second half-shell (3), and in a two-stage version, two such impellers (1, 1a) in a casing formed from two outer half-shells (2) separated by an intermediate half-shell (10) positioned between the impellers; the second half-shell has a raised rim, creating a half-chamber (7) that coincides with the position of inlet and outlet ports incorporated into the first half-shell, the intermediate half-shell in the two-stage unit consisting in two such second half-shells matched symmetrically with their two rims combining to create a sealed chamber (8) the opposite bases of which are pierced to provide an outlet from the first stage and an inlet into the second, internally of the casing.

4 Claims, 2 Drawing Sheets

Fig. 1
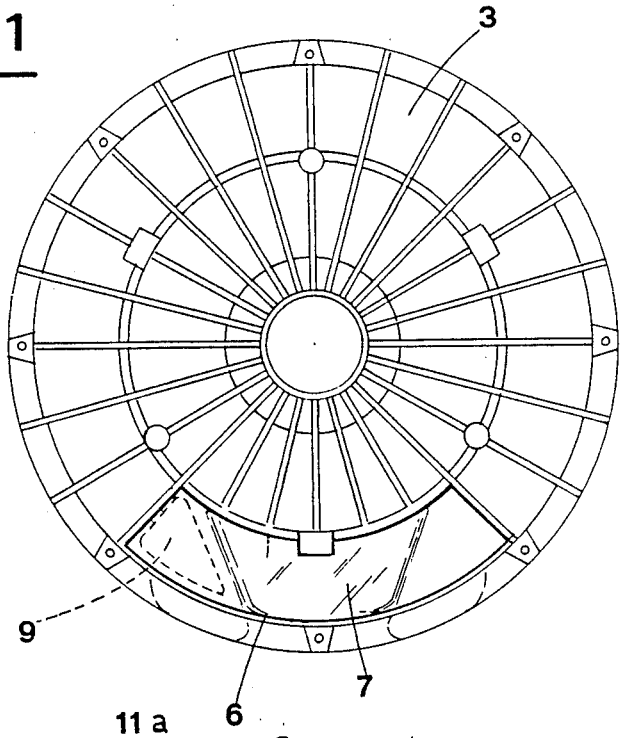
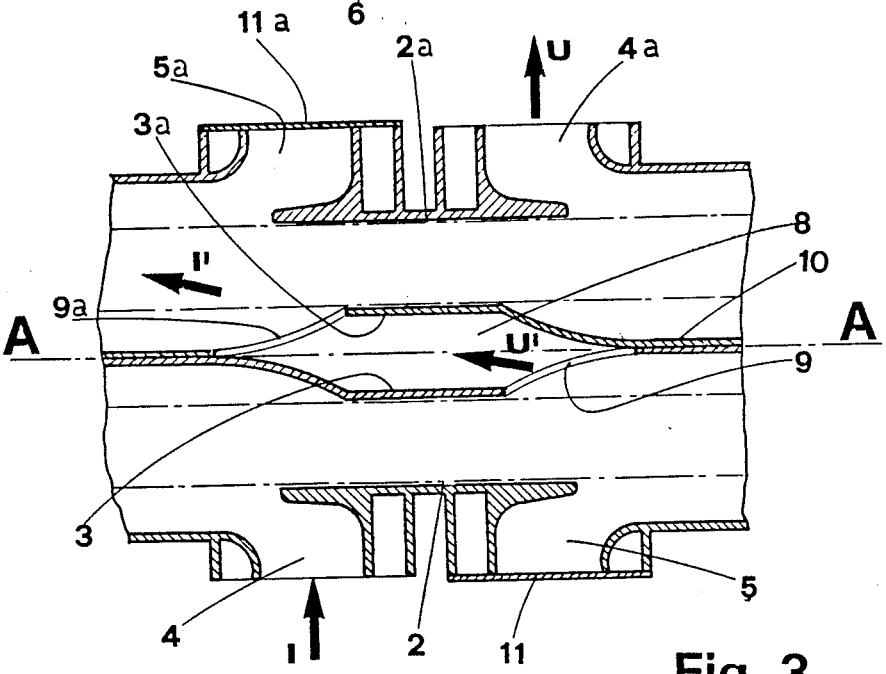
Fig. 3

DISPLACEMENT TYPE ROTARY INDUCTION-BLOWER MACHINE

BACKGROUND OF THE INVENTION

The invention relates to a displacement type rotary air induction-and-blower machine.

Machines of the type in question, known as side channel machines, substantially comprise a vaned impeller accommodated internally of a casing that consists in a first and a second half-shell paired together in such a way as to create an annular channel, that is, the side channel from which the machine takes its name, and internally of which the vanes of the impeller rotate. The two ends of the annular channel afford an inlet port and an outlet port through which fluid is drawn into and expelled from the machine, respectively. In most instances, the inlet and outlet ports are formed in the first half-shell, to which the impeller drive motor is also connected, whilst the second half-shell serves simply as a cover, and as a means of encasing a part of the annular channel.

It is common practice to connect two such machines in series so as to form a two-stage unit. In such a situation, the casing which contains the impellers will comprise not only two outer half-shells, but also an intermediate half-shell that separates the two stages.

Conventionally, the two-stage unit utilizes two half-shells of special shape, incorporating ducts that connect the outlet of the first stage with the inlet of the second stage; besides creating certain leakage problems connected with the passage of the fluid through the ducts, such an arrangement brings the additional drawback that to enable construction of both single- and two-stage machines, a number of different molds are required, signifying increased manufacturing and stock-related costs.

A second type of arrangement consists in cascading two standard single-stage units in direct fashion, rotating the casings through a given angle about the axes of their impellers in such a way that the inlet of the second stage can be offered to the outlet of the first stage; while simple enough in principle, such an arrangement is beset nonetheless by the serious drawback that two sharp changes in direction (each of 90°) are imposed on the fluid, the result of which is a heavy loss of efficiency in the combined two-stage unit.

Accordingly, the object of the present invention is one of overcoming the drawbacks described above by providing a machine that can be embodied in both single stage and two-stage versions utilizing the same casing components, subject to a minimum of modification obtainable through simple machining operations, and which, in the two-stage version, enables a limitation of the length and tortuousness of the path followed by the fluid exiting from the first stage and entering the second.

SUMMARY OF THE INVENTION

The stated object is realized, with others besides, by adoption of the machine disclosed, which is of the type comprising at least one impeller enclosed by a casing formed from a first and a second half-shell combining to create an annular channel inside of which the vanes of the impeller rotate, and an inlet port and an outlet port located in the same first half-shell of the casing at respective ends of the channel; according to the invention, the second half-shell is provided externally with a raised, unbroken rim encompassing a half-chamber localized at a position which corresponds to that of the inlet and outlet ports afforded by the first half-shell.

In the two-stage version of the machine disclosed, the intermediate half-shell separating the two impellers comprises two such second half-shells matched together with their two rims combining to create a chamber isolated from the surrounding environment and connected with the outlet of the first stage and the inlet of the second stage by way of respective openings formed one in the base of each half-chamber.

BRIEF DESCRIPTION OF THE DRAWINGS

The invention will now be described in detail, by way of example, with the aid of the accompanying drawings, in which:

FIG. 1 is an external front view of the second half-shell of the machine casing;

FIG. 3 shows part of a section through the machine of FIG. 2, taken along III—III.

DESCRIPTION OF THE PREFERRED EMBODIMENTS

Figure 2:
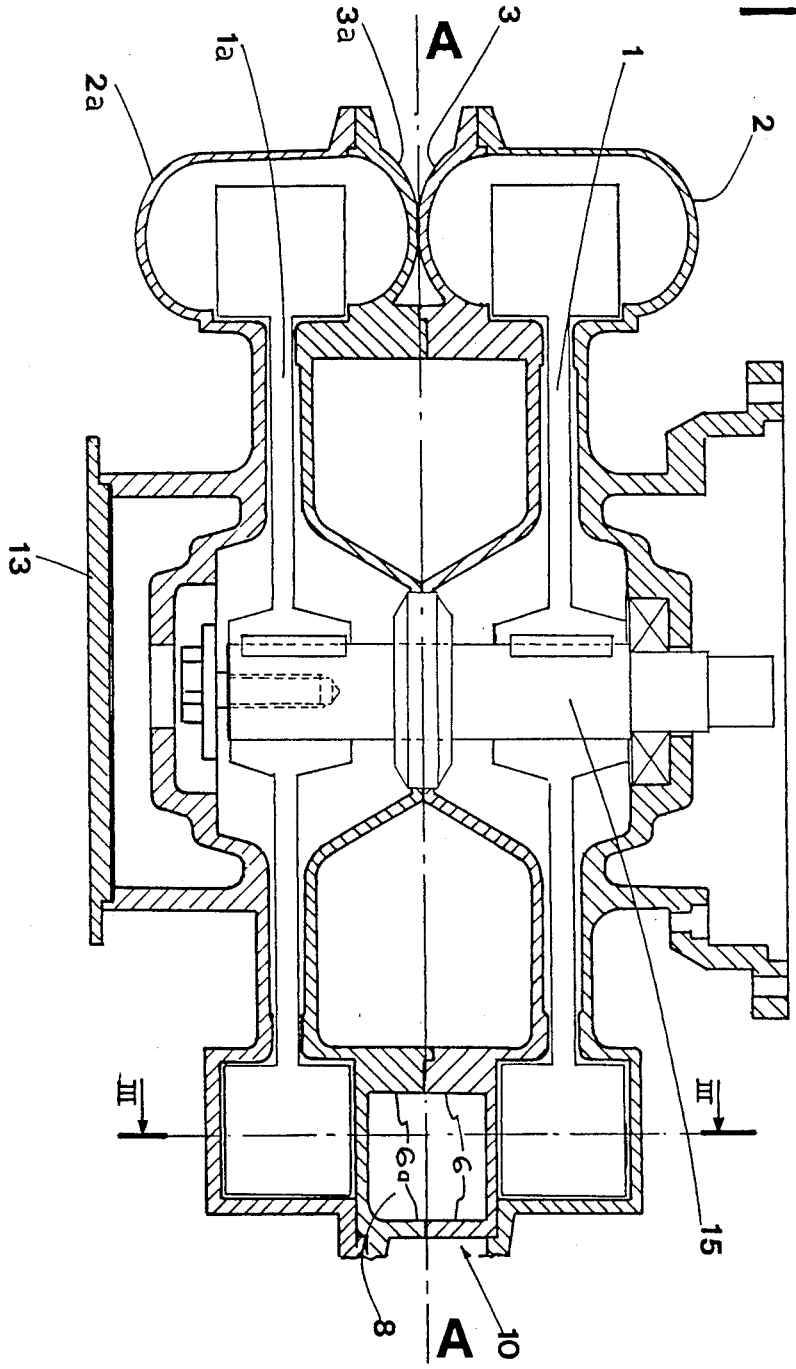
FIG. 2 is a section through the two-stage version of the machine disclosed, seen in vertical elevation, in which the intermediate half-shell is obtained by connecting together two second half-shells.

The single-stage version of the machine comprises a vaned impeller 1 housed within a casing formed from a first half-shell 2, and a second half-shell 3; the two half-shells combine to create a channel of annular shape internally of which the vanes of the impeller rotate. The impeller is set in rotation by the shaft 15 of an electric motor, mounted to the first half-shell 2 either directly or by way of a flange. Whilst the single-stage machine proper is not illustrated in the drawings, its embodiment (conventional at all events) is easily discernible from FIG. 2, given that a single-stage unit is quite simply the part of the two-stage unit lying to the right of the plane of symmetry denoted A—A. It will be observed also that the numbers denoting parts of the single-stage machine are those located in the right half of FIG. 2, and the bottom half of FIG. 3, with respect to the plane of symmetry A—A.

4 denotes an inlet port, and 5 an outlet port, both of which are formed in the bottom part of the first half-shell 2.

6 denotes a space-encompassing, unbroken rim raised from the outward facing surface of the second half-shell 3, the precise purpose of which is to create an outwardly directed half-chamber 7. More exactly, the rim is located opposite the inlet and outlet ports in the first half-shell, with its unbroken outline positioned and proportioned such that when projected through a direction parallel with the axis of the impeller onto the first half-shell, it circumscribes the two ports entirely as discernible from FIG. 3.

In the single-stage unit, the second half-shell 3 is blank at center (see FIG. 1), as also is the base of the half-chamber 7, whereas in the two-stage unit, shortly to be described in greater detail, the half-shell 3 is provided with a hole at center to admit the impeller shaft 15, and with an opening illustrated in phantom line and denoted 9 in FIG. 1, the purpose of which will eventually become clear. For reasons shortly to be explained, the outermost frontal surface of the raised rim 6 lies within a plane lying perpendicular to the impeller axis, in relation to which the second half-shell 3 occupies the space entirely to one side.

Assembly of the two stage machine shown in FIGS. 2 and 3, which requires just a few simple preliminary operations (shortly to be described), involves pairing together two single-stage units by offering their respective second half-shells 3 and 3*a* one to the other to create the intermediate half-shell 10. When fully assembled, the casing of the two-stage machine consists in two outer half-shells, which are in effect two first half-shells 2 as described above, and an intermediate half-shell 10 created by the union of two second half-shells 3.

In the two-stage version of the machine (see FIGS. 2 and 3), the outer half-shell denoted 2*a* will be without a mounting flange, given that the motor is secured to the outer half-shell 2 at the opposite side; instead, use is made of a plain flange 13 that performs the function of a cover by blanking off the center hole in the half-shell 2*a*.

Similarly, the outlet port 5 of the first stage and the inlet port 5*a* of the second stage are blanked off externally by respective screw caps 11 and 11*a*, as clearly visible in FIG. 3.

Before assembly, the two second half-shells 3 and 3*a* are machined true and cut out at center, and the opening 9 is cut in each half-chamber 7. This done, the two parts are fitted together in such a way as to match together the two rims 6 and 6*a*, which thus combine to create a chamber denoted 8. Preliminary machining not only ensures that the rims 6 and 6*a* of the two half-shells 3 and 3*a* fit faultlessly together, but serves also to create several other locating surfaces in the same plane as that of the rim surfaces, which facilitate matching of the two parts. The chamber 8 connects with the outlet from the first stage by way of the hole 9 cut into the base of the one half-shell 3, and with the inlet to the second stage via the corresponding hole 9*a* in the base of the other half-shell 3*a*.

To advantage, the second half-shells 3 and 3*a* are machined and cut out in one and the same operation, given that the center must in any case be removed in order to admit the shaft 15 which carries the impellers 1 and 1*a* and sets them in rotation; the operation of matching the two half-shells 3 and 3*a* to produce the intermediate half-shell 10 is made especially swift and simple by the machining pass. At all events, the main aim of the operation in question is to create a chamber 8 isolated from the surrounding environment; accordingly, the self-same end might be achieved simply by matching together two unmachined half-shells 3 and 3*a* and inserting distance pieces and seals between them, designed respectively to guarantee a secure fit between the two parts and a tight seal between the chamber 8 and the surrounding environment.

As FIG. 3 clearly indicates, fluid is drawn into the machine through the inlet I by way of the relative port 4, leaves the first stage via the outlet U', passing through the first hole 9 and across the chamber 8, gains the second stage inlet I' by way of the second hole 9*a*, and discharges finally from the second stage outlet U via the relative port 4*a*; accordingly, the entire flow path is free from any sudden change in direction that would inevitably cause loss of efficiency.

Construction of the rotary machine thus described is rendered considerably simple according to the invention, in the case both of the single-stage unit and of the two-stage unit; there is no need to stock different parts for different versions of the machine, neither does any requirement exist for different shell molds for different versions.

Tests conducted on the practical level have shown the two stage unit to be especially efficient, particularly when compared with conventional two-stage units of the type obtained by connecting standard one-stage units in cascade.

What is claimed:

1. A displacement type rotary induction-blower machine comprising:
   - at least one vaned impeller having an axis and a plurality of vanes;
   - a casing formed from a first half-shell (2) and a second half-shell that combine to create an annular channel internally of which the vanes of the impeller rotate;
   - an inlet port and an outlet port defined by the first half-shell of the casing and located respectively at entry and exit ends of the channel;
   - a rim defined by the exterior of the second half-shell, that serves to create a single outward-facing half-chamber and is aligned with both of the inlet and outlet ports of the first half-shell at the same time so as to have an outline which, when projected through a direction parallel with the axis of the impeller onto the first half-shell, circumscribes both ports completely.

2. A machine as in claim 1, wherein an outermost frontal surface of the rim occupies a plane normal to the impeller axis, and an entire bulk of the second half-shell is contained within space lying to one side of said plane.

3. A machine as in claim 1, embodied in two stages with two respective impellers, the casing of which comprises two outer half-shells and an intermediate half-shell, the intermediate half-shell having two second half-shells arranged symmetrically one to the other so that matched rims combine to create a chamber that is isolated from an external environment and connects with the outlet of the channel occupied by the first impeller by way of openings created in bases of the respective half-chambers which are encompassed by the rims, the outlet port being occupied by the first impeller and the inlet port being occupied by the second impeller, said inlet and outlet ports being blanked off by respective caps.

4. A machine as in claim 3, wherein the external face of each second half-shell combine to form the intermediate half-shell and provide a plurality of locating surfaces disposed within a common plane through which the half-shells are united, the outermost frontal surfaces of the rims being disposed within the plane occupied by the locating surfaces.

* * * * *